US010177487B2

(12) United States Patent
Chen et al.

(10) Patent No.: US 10,177,487 B2
(45) Date of Patent: Jan. 8, 2019

(54) ELECTRICAL CONNECTOR ASSEMBLY

(71) Applicant: FOXCONN INTERCONNECT TECHNOLOGY LIMITED, Grand Cayman (KY)

(72) Inventors: De-Jin Chen, ShenZhen (CN); Xing-Liang Liu, Shenzhen (CN); Yu-San Hsiao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/635,230

(22) Filed: Jun. 28, 2017

(65) Prior Publication Data

US 2017/0373432 A1 Dec. 28, 2017

(30) Foreign Application Priority Data

Jun. 28, 2016 (CN) ..... 2016 1 0480796

(51) Int. Cl.
*H01R 13/52* (2006.01)
*H01R 13/627* (2006.01)

(52) U.S. Cl.
CPC ..... *H01R 13/5219* (2013.01); *H01R 13/521* (2013.01); *H01R 13/6273* (2013.01)

(58) Field of Classification Search
CPC ..... H01R 13/5219; H01R 13/5221; H01R 13/62933; H01R 13/62966; H01R 13/62972; H01R 13/521; H01R 13/6273
USPC ..... 439/271–277, 372
See application file for complete search history.

(56) References Cited

U.S. PATENT DOCUMENTS

| | | | | |
|---|---|---|---|---|
| 4,932,875 | A * | 6/1990 | Ogawa | H01R 13/5221 439/271 |
| 6,053,754 | A * | 4/2000 | Kano | H01R 13/5221 439/281 |
| 7,083,462 | B1 * | 8/2006 | Chen | H01R 13/62966 439/362 |
| 8,029,307 | B2 * | 10/2011 | O'Rourke | H01R 13/6392 439/372 |
| 2002/0052154 | A1 * | 5/2002 | Takatsuki | H01R 13/4365 439/752 |
| 2004/0137777 | A1 * | 7/2004 | Fukuda | H01R 13/5219 439/349 |
| 2005/0191899 | A1 * | 9/2005 | Solano | H01R 13/521 439/519 |
| 2006/0270255 | A1 * | 11/2006 | Ishikawa | H01R 13/631 439/141 |

(Continued)

FOREIGN PATENT DOCUMENTS

| | | |
|---|---|---|
| TW | M267724 | 6/2000 |
| TW | M517448 | 2/2016 |

*Primary Examiner* — Gary F Paumen
(74) *Attorney, Agent, or Firm* — Wei Te Chung; Ming Chieh Chang

(57) ABSTRACT

An electrical connector assembly includes a cable connector equipped with a locking device essentially composed of an operation part pivotally mounted to the case, and a locking part pivotally mounted to the operation part, and a host connector equipped with a locking ear for locking with the locking part wherein the host connector forms a forward protrusion to form an outer region and an inner region each provided with a sealing member adapted to be compressed in the front-to-back direction by locking mechanism.

15 Claims, 8 Drawing Sheets

(56) References Cited

U.S. PATENT DOCUMENTS

| | | | | |
|---|---|---|---|---|
| 2014/0051286 | A1* | 2/2014 | Itsuki | H01R 13/533<br>439/587 |
| 2015/0207263 | A1* | 7/2015 | Fabre | H01R 13/506<br>439/271 |
| 2015/0244099 | A1* | 8/2015 | Lee | H01R 13/508<br>439/660 |
| 2017/0288336 | A1* | 10/2017 | Okamoto | H01R 13/5219 |

* cited by examiner

ELECTRICAL CONNECTOR ASSEMBLY

BACKGROUND OF THE DISCLOSURE

1. Field of the Disclosure

The present disclosure relates to an electrical connector assembly, and particularly to an electrical connector assembly equipped with locking mechanism thereof.

2. Description of Related Arts

As disclosed in Taiwan patent No. M517448, locking mechanism is provided between the receptacle connector and the cable connector. Even though it provides a locking function during mating, it fails to perform a reliable waterproof function therebetween.

An improved electrical connector is desired.

SUMMARY OF THE DISCLOSURE

Accordingly, an object of the present disclosure is to provide an electrical connector assembly with reliable and enhanced waterproof function derived from the corresponding associated locking mechanism.

To achieve the above object, an electrical connector assembly includes a cable connector equipped with a locking device essentially composed of an operation part pivotally mounted to the case, and a locking part pivotally mounted to the operation part, and a host connector equipped with a locking ear for locking with the locking part wherein the host connector forms a forward protrusion to form an outer region and an inner region each provided with a sealing member adapted to be compressed in the front-to-back direction by locking mechanism.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
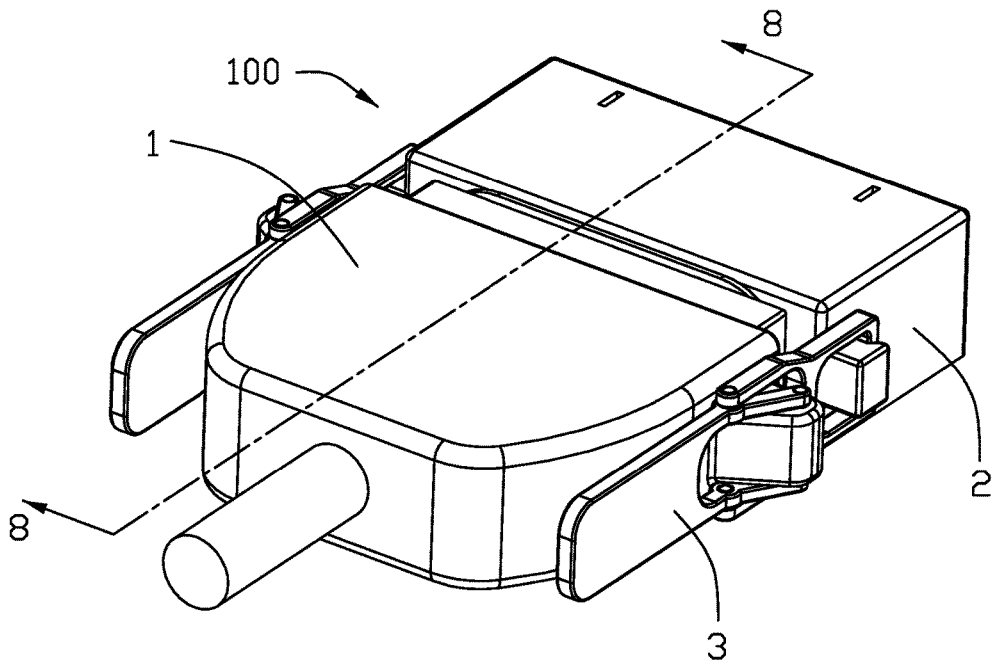
FIG. 1 is a perspective view of an electrical connector assembly including a cable connector and a host connector mated and locked together.
Figure 2:
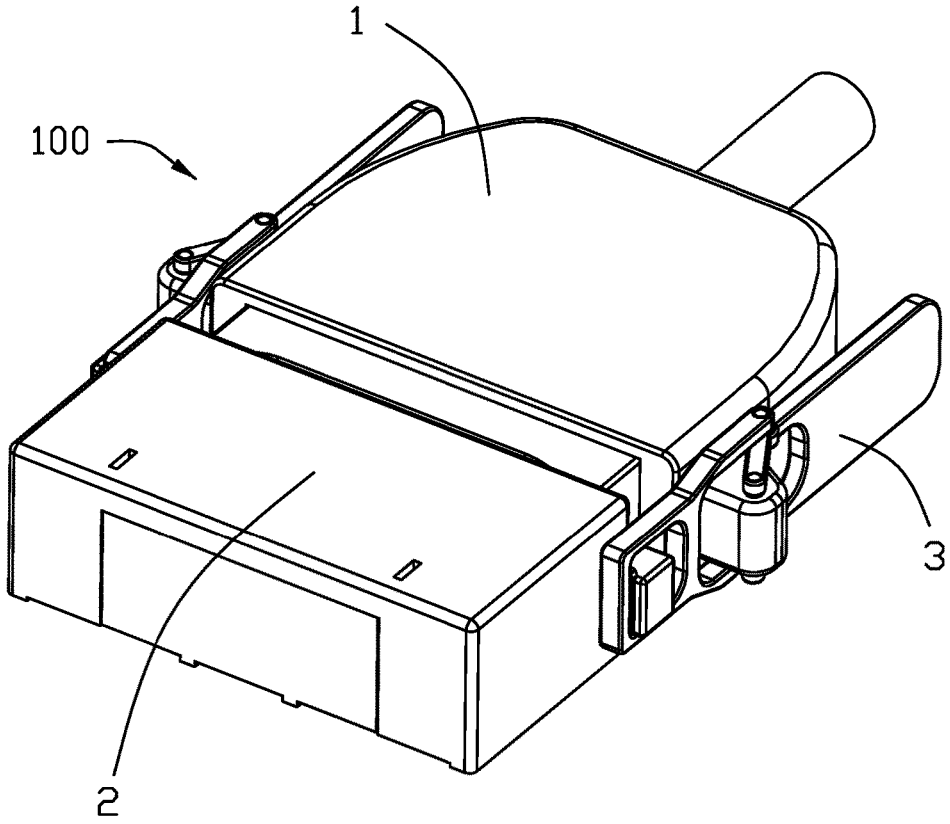
FIG. 2 is another perspective view of the electrical connector assembly of FIG. 1.
Figure 3:
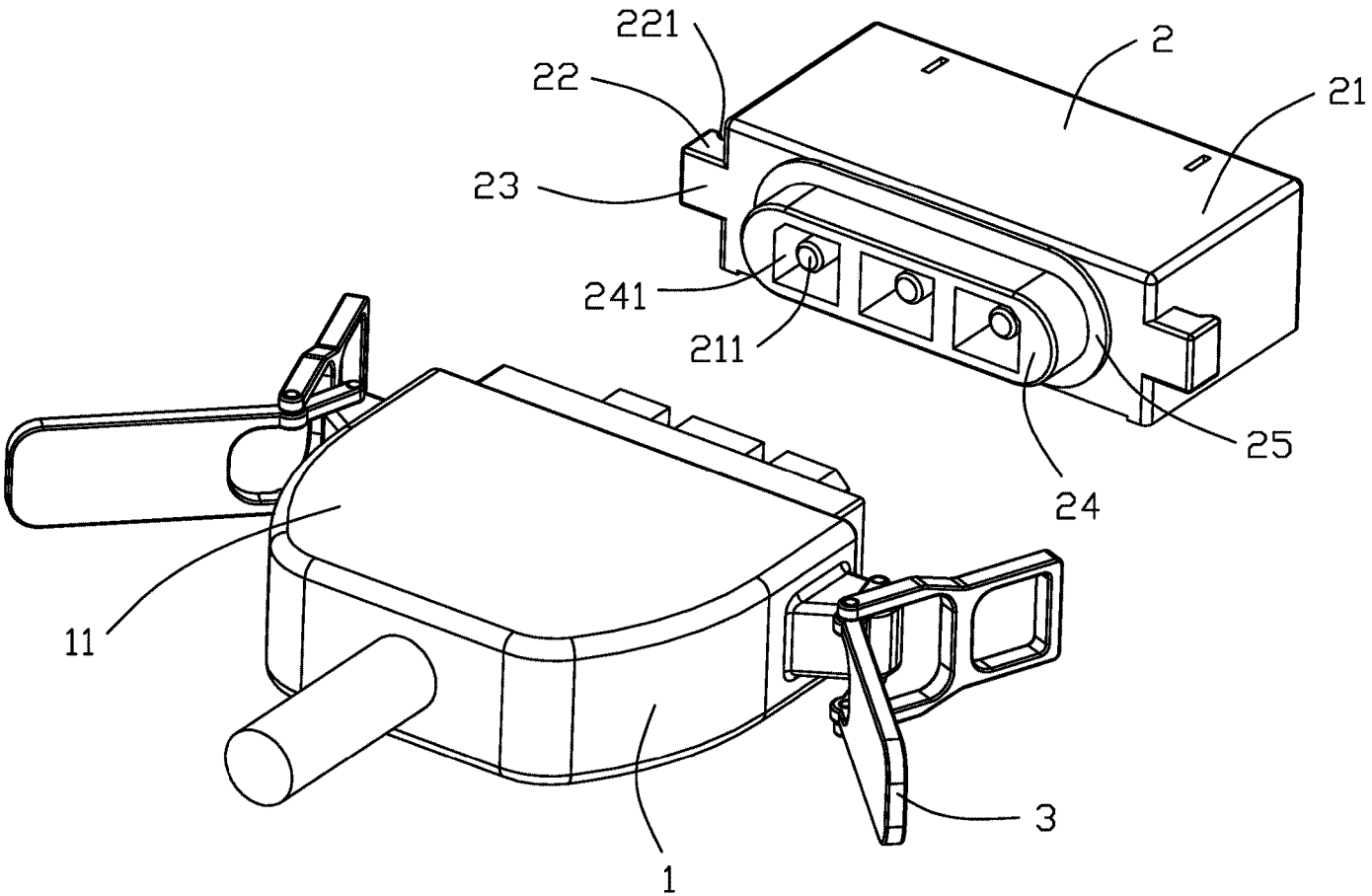
FIG. 3 is a perspective view of the electrical connector assembly of FIG. 1 with the cable connector and the host connector separated from each other.
Figure 4:
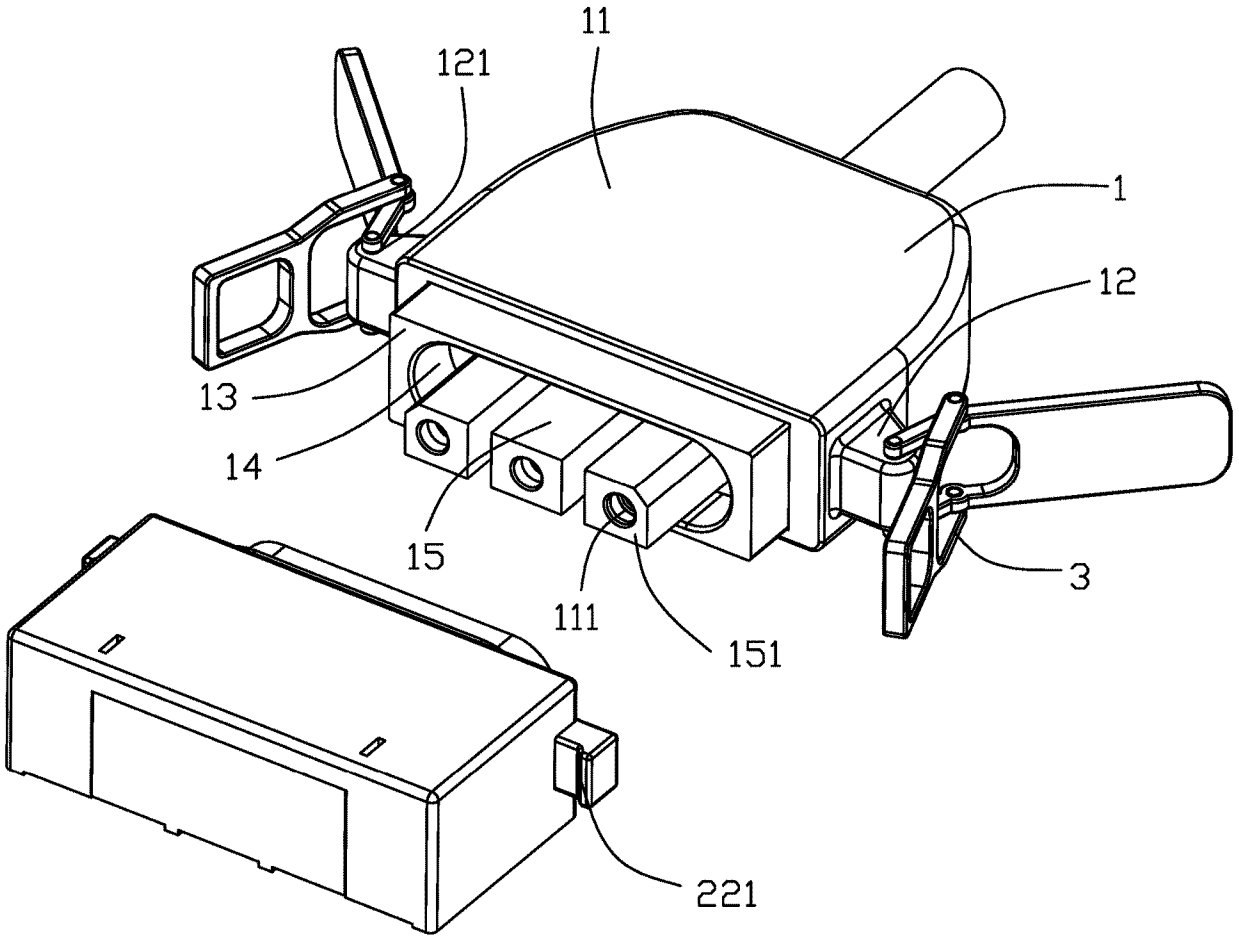
FIG. 4 is another perspective view of the electrical connector assembly of FIG. 3.
Figure 5:
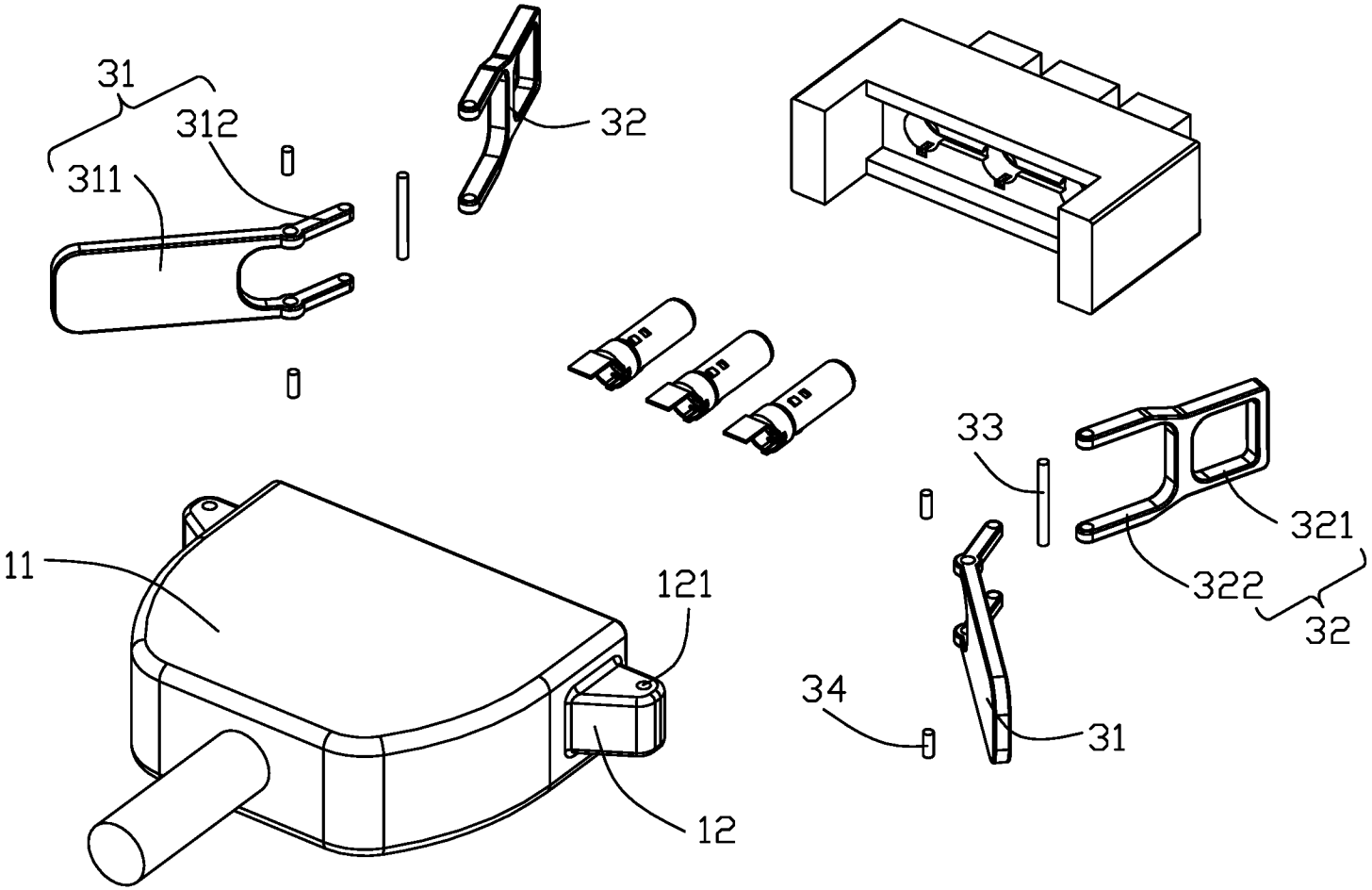
FIG. 5 is an exploded perspective view of the cable connector of the electrical connector assembly of FIG. 3.
Figure 6:
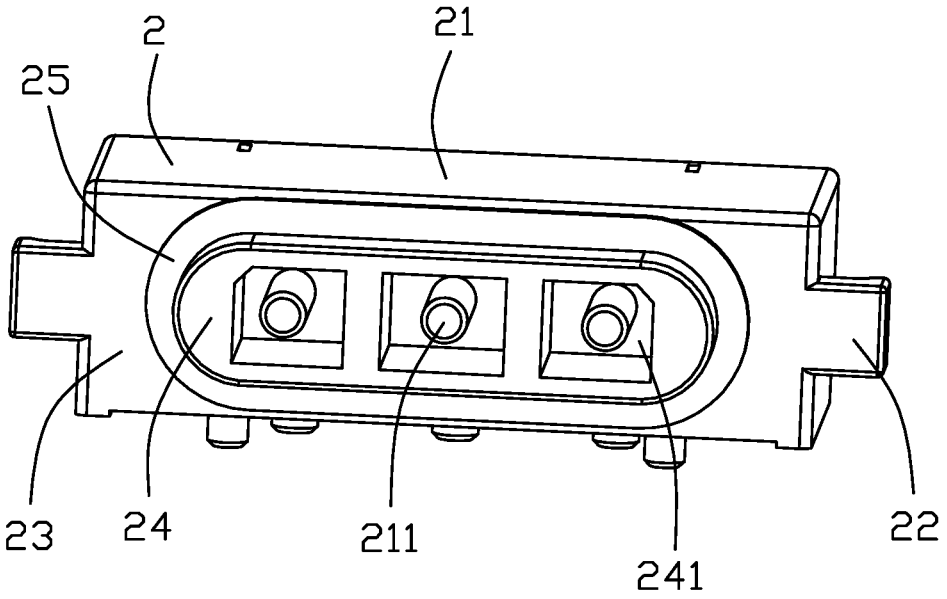
FIG. 6 is a perspective view of host connector of the electrical connector assembly of FIG. 3.
Figure 7:
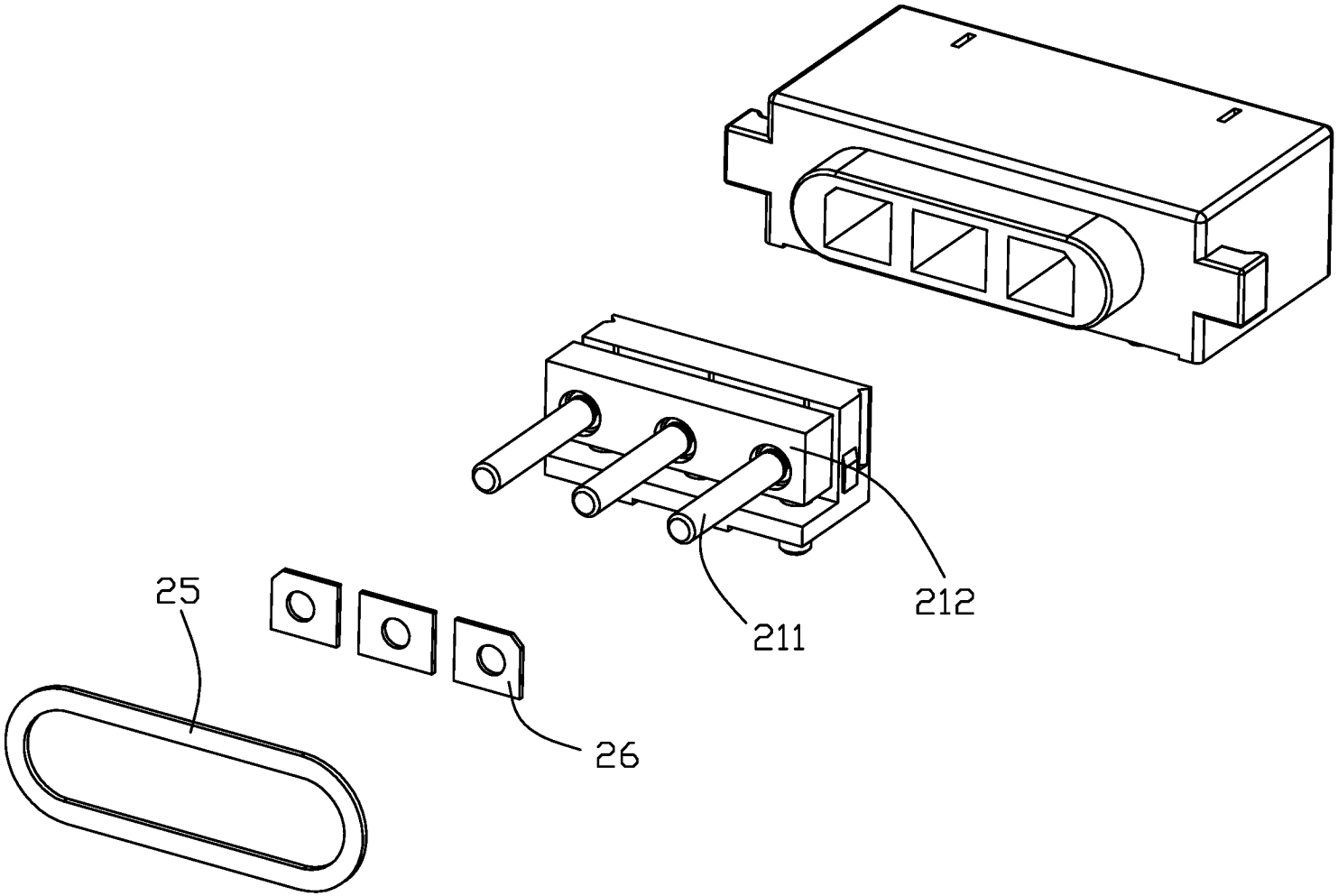
FIG. 7 is an exploded perspective view of the host connector of FIG. 6.
Figure 8:
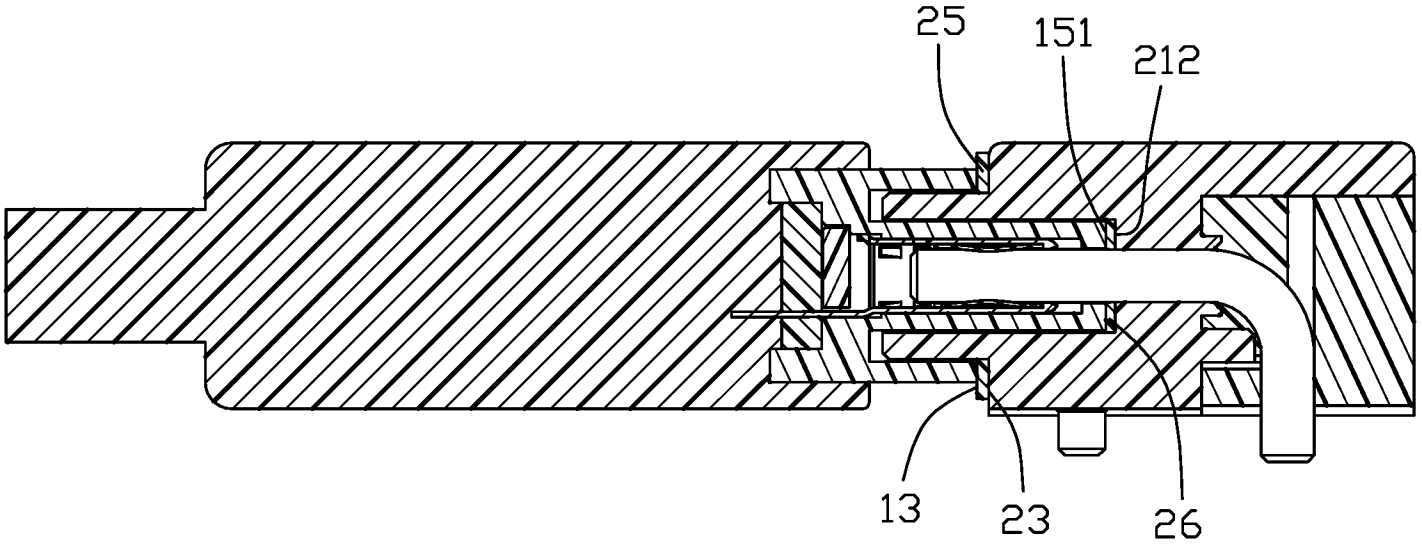
FIG. 8 is a cross-sectional view of the electrical connector assembly of FIG. 1.

Reference will now be made in detail to the embodiments of the present disclosure. The insertion direction is a front-to-rear direction. Referring to FIGS. 1-8, an electrical connector assembly 100 includes a cable/plug connector 1 and a host/receptacle connector 2 adapted to be mated with each other. The cable connector 1 includes a main portion 11, a plurality of terminals 111 disposed in the main portion 11, and a pair of locking devices 3 on two lateral sides of the main portion 11. The host connector 2 includes a main body 21, a plurality of terminals 211 disposed in the main body 21 for mating with the terminals 111, and a pair of locking ears 22 on two lateral sides of the main body 21 for engagement with the corresponding locking devices 3.

The cable connector 1 includes a pair of mounting portions 12 on two sides of the main portion 11 with pivot holes 121 for locking devices 3 to be pivotally mounted thereon. The cable connector 1 includes a (first) mating face 13 with a receiving cavity 14 inwardly recessed therefrom, and a plurality of mating poles 15 formed in the receiving cavity 14 to receive the corresponding terminals 111 therein and forwardly extending beyond the mating face 13.

In the host connector 2, the pair of locking ears 22 project outwardly and laterally from two opposite lateral sides of the main body 21. The host connector 2 further includes a (second) mating face 23 for mating with the (first) mating face 13, and a receiving pole 24 with a plurality of mating holes 241 receiving the corresponding terminals 211 for receiving the mating poles 15 therein during mating.

The locking device 3 includes an operation part 31 pivotally mounted to the mounting portion 12, and a locking part 32 pivotally mounted upon the operation part 31. The operation part 31 includes an operation section 311 and a pair of first arms 312 extending from the operation section 311 with an obtuse angle therebetween. The first arms 312 is pivotally mounted into the pivot hole 121 via a pivot 33. In this embodiment, the first arms 312 straddle the mounting portion 12. The locking part 32 includes a window type locking section 321 and a pair of second arms 322 extending from the locking section 321. The second arms 322 are pivotally linked to the first arms 312 via other pivots 34 which is located inside of the pivot 33 in a transverse direction perpendicular to the front-to-back (mating) direction. Based upon the foregoing structures, by rotation of the operation part 31, the locking part 32 can be engaged with or disengaged from the corresponding locking ear 22 wherein the hook 221 on the locking ear 22 may efficiently engage the corresponding locking section 321.

To enhance the waterproof performance, in the host connector 2, the receiving pole 24 is provided with an outer sealing member 25 attached upon the second mating face 23 and surrounding said receiving pole 24, and a plurality of inner sealing members 26 each surrounding the corresponding terminal 211. Notably, the first mating face 13 cooperate with the second mating face 23 to sandwich and compress the sealing member 25 therebetween in the front-to-back (mating) direction. Similarly, the sealing member 26 is sandwiched and compressed between the third mating face 151 which is located at a front end face of each mating pole 15, and the fourth mating face 212 which is located at the inner end face of each mating hole 241 which is adapted to receive the corresponding mating pole 15.

In conclusion, coupling between the cable connector 1 and the host connector 2 is assured by the locking mechanism for not only electrical connection therebetween but also waterproofing both inside the receiving pole 24 and outside the receiving pole 24 via the inner sealing member 26 and the outer sealing member 25 both of which are compressed in the front-to-back (mating) direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a cable connector and a host connector adapted to be mated with each other in a mating direction, the cable connector including: an insulative main portion; a plurality of terminals disposed in the insulative main portion; a pair of locking devices pivotally mounted upon two opposite lateral sides of the main portion; and the host connector including: an insulative main body; a plurality of terminals disposed in the insulative main body; a pair of locking ears formed on two opposite lateral sides of the main body; one of the main portion and the main body forming a receiving pole equipped with an inner sealing member inside the mating pole surrounding the corresponding terminals, and an outer sealing member outside the mating pole surrounding the mating pole; wherein during mating and coupling, both of said inner sealing member and said outer sealing member are compressed in said mating direction by cooperation of said pair of locking devices and said locking ears.

2. The electrical connector assembly as claimed in claim 1, wherein the receiving pole forms a plurality of mating holes therein, and the other of said main portion and said main body forms a plurality of mating poles receiving the corresponding terminals therein and adapted to be received within the corresponding mating holes, respectively.

3. The electrical connector assembly as claimed in claim 2, wherein said inner sealing member is compressed by a front end of each of said mating poles.

4. The electrical connector assembly as claimed in claim 1, wherein the other of the main portion and the main body forms a mating face extending beyond a front end of the receiving pole to abut against the outer sealing member during mating.

5. The electrical connector assembly as claimed in claim 1, wherein said inner sealing member is located farther from a front end of the receiving pole than said outer sealing member is.

6. The electrical connector assembly as claimed in claim 5, wherein the terminals surrounded by the inner sealing member, have front ends which are located nearer to the front end of the receiving pole than the outer sealing member is.

7. The electrical connector assembly as claimed in claim 1, wherein the other of said main portion and said main body forms a receiving cavity to receive the receiving pole.

8. The electrical connector assembly as claimed in claim 1, wherein said receiving pole is formed on the host connector, and the mating poles are formed on the cable connector.

9. A host connector for coupling in a mating direction to a cable connector having a pivotal locking device therewith, comprising:

an insulative main body;

a plurality of terminals disposed in the insulative main body; a pair of locking ears formed on two opposite lateral sides of the main body for engagement with the locking device; the main body forming a receiving pole equipped with an inner sealing member inside the mating pole surrounding the corresponding terminals, and an outer sealing member outside the mating pole surrounding the mating pole; wherein both said inner sealing member and said outer sealing member are compressed in said mating direction by the locking device during mating with the cable connector, wherein the receiving pole forms a plurality of mating holes, and the inner sealing member includes a plurality of pieces respectively disposed at an end face of the corresponding mating hole.

10. The electrical connector as claimed in claim 9, wherein said locking ears are located behind a front end of the receiving pole in the mating direction.

11. The electrical connector as claimed in claim 9, wherein the outer sealing member is located in front of the locking ears in the mating direction.

12. The electrical connector as claimed in claim 9, wherein said outer sealing member is located in front of the inner sealing member in the mating direction.

13. A cable connector assembly comprising:

a cable connector and a host connector adapted to be mated with each other in a mating direction, the cable connector including:

an insulative main portion defining a receiving cavity therein with a plurality of mating poles extending beyond a front face of the main portion;

a plurality of terminals disposed in the corresponding mating poles, respectively;

a pair of locking devices mounted upon two opposite lateral sides of the main portion, each of said locking devices including an operation part pivotally mounted upon the main portion via a first pivot, and a locking part pivotally mounted to the operation part via a second pivot and configured to be adapted to be locked to a host connector;

wherein during mating, a first sealing member is compressed by the front face of the main portion, and a second sealing member is compressed by a front face of each mating pole via assistance of locking devices; wherein said second pivot is located inside of said first pivot in a transverse direction perpendicular to said mating direction.

14. The cable connector as claimed in claim 13, wherein the main portion includes a pair of mounting portions on which the locking devices are pivotally mounted.

15. The cable connector as claimed in claim 13, wherein the locking part forms a window type locking section and a pair of arms extending from the locking section and pivotally mounted to the operation part via said second pivot.

* * * * *